US010532404B2

(12) United States Patent
Sanada et al.

(10) Patent No.: US 10,532,404 B2
(45) Date of Patent: Jan. 14, 2020

(54) POWDER MATERIAL PACKING METHOD

(71) Applicant: TOYOTA JIDOSHA KABUSHIKI KAISHA, Toyota-shi (JP)

(72) Inventors: Yoshiyuki Sanada, Toyota (JP); Kazumichi Nakatani, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 373 days.

(21) Appl. No.: 15/453,524

(22) Filed: Mar. 8, 2017

(65) Prior Publication Data

US 2017/0259335 A1 Sep. 14, 2017

(30) Foreign Application Priority Data

Mar. 14, 2016 (JP) ..... 2016-049831

(51) Int. Cl.
*B22F 3/03* (2006.01)
*B22F 3/00* (2006.01)

(52) U.S. Cl.
CPC ..... *B22F 3/03* (2013.01); *B22F 3/004* (2013.01)

(58) Field of Classification Search
CPC . B22F 3/03; B22F 3/004; B29C 31/04; B29C 41/02; B29C 2043/5875; B29C 2043/5883; B29C 43/34; B29C 2043/3438; B30B 15/304
USPC ..... 419/66
See application file for complete search history.

(56) References Cited

U.S. PATENT DOCUMENTS

2002/0051726 A1* 5/2002 Nakamura ..... B22F 3/004 419/38

FOREIGN PATENT DOCUMENTS

| | | |
|---|---|---|
| JP | 4-210896 | 7/1992 |
| JP | 2002-192391 | 7/2002 |
| JP | 2004-107702 | 4/2004 |
| JP | 2006-37219 | 2/2006 |
| JP | 2008-69417 A | 3/2008 |
| JP | 4953840 B2 | 6/2012 |

* cited by examiner

*Primary Examiner* — Jessee R Roe
*Assistant Examiner* — Rebecca Janssen
(74) *Attorney, Agent, or Firm* — Oblon, McClelland, Maier & Neustadt, L.L.P.

(57) ABSTRACT

In molding a compact having portions of an equal thickness on opposite sides of a through-hole, an advancing speed of a holder holding a powder material is adjusted before the holder is advanced and retracted over a die cavity of a die. Specifically, a first preparation of determining in advance a relation between the advancing speed of the holder and a packing density of the powder material packed in the die cavity at each of the portions to be of an equal thickness of the compact on opposite sides of the through-hole is made; and, based on the relation determined in the first preparation, the advancing speed of the holder is adjusted to a speed at which the packing density becomes uniform. Thus, the packing density of the powder material packed in the die cavity can be uniformized, so that the dimensional accuracy of the molded compact can be improved.

10 Claims, 7 Drawing Sheets

POWDER MATERIAL PACKING METHOD

INCORPORATION BY REFERENCE

The disclosure of Japanese Patent Application No. 2016-049831 filed on Mar. 14, 2016 including the specification, drawings and abstract is incorporated herein by reference in its entirety.

BACKGROUND

1. Technical Field

The present disclosure relates to a method for packing a powder material of a compact into a die cavity of a die used for molding a compact.

2. Description of Related Art

In the technology of compression-molding a powder material, such as a metal powder, with a die into a compact of a desired shape, attempts have been hitherto made to achieve a uniform density of the molded compact by contriving a method for packing the powder material into a die cavity of the die (e.g., see Japanese Patent Application Publication No. 2002-192391 and Japanese Patent Application Publication No. 4-210896). The packing density of the powder material varies according to the manufacturing process, management conditions, etc. thereof, and especially when the manufacturing lot of the powder material is changed, the packing density can change significantly. Therefore, to produce a compact having a desired strength or packing density, it is necessary to adjust the amount of packing (packing depth) of the powder material in the die according to the packing density of the powder material. For example, FIG. 4 shows a state where a powder material M is packed in a die cavity 36 of a die of which heights of a die plate 34 and a lower inner 38 relative to each other are adjustable. In the example of FIG. 4, the position of the die plate 34 is adjusted so that an upper surface 34*a* of the die plate 34 is located at a position higher than the position of an upper surface 38*a* of the lower inner 38. As a result, a difference in height (submersion depth) indicated by reference sign H is left between the die plate 34 and the lower inner 38. In the example of FIG. 4, to pack the powder material M into the die cavity 36 of the die, a holder 12 that holds the powder material M is brought into sliding contact with the upper surface 34*a* of the die plate 34, with a bottom surface of the holder 12 open, and the holder 12 is advanced and retracted over the die cavity 36.

SUMMARY

According to the above packing method, a part of the powder material M is dragged to a rear side as the holder 12, which moves while feeding the powder material M into the die cavity 36 when advancing, passes over an upper side of the powder material M packed in the die cavity 36 when retracting. As a result, the powder material M fed in the die cavity 36 has a higher packing density on the rear side (left side in FIG. 4) than a front side (right side in FIG. 4) in an advancing direction of the holder 12. Thus, even when the compact is designed to have portions of an equal thickness on the front side and the rear side, the molded compact has a front-rear difference in thickness between these portions. The present inventors have confirmed that the phenomenon is conspicuous especially when the submersion depth H is set. Any such front-rear difference in thickness is counted as a material defect or processing defect, and makes it necessary to suspend the production for adjustment of equipment etc. Moreover, the fluidity of the powder material that has a direct influence on the packing density of the powder material M and the amount of powder material M dragged by the holder 12 is difficult to control, as the fluidity varies due to all possible influences the powder material is subjected to from the time of manufacturing, including the particle size, shape, composition, amount of lubricant, humidity, and electric charging.

The present disclosure provides a method that improves the dimensional accuracy of a molded compact by uniformizing a packing density of a powder material.

Aspects of Disclosure

The following aspects of the present disclosure, which are examples of configurations of the disclosure, will be described item by item to facilitate understanding of the various configurations of the present disclosure. These items are, however, not to limit the technical scope of the disclosure. Instead, the technical scope of the disclosure can include other configurations in which components of one item are partially replaced or omitted or other components are added thereto with the best mode for implementing the disclosure taken into account.

(1) A method for packing a powder material into a die cavity by dropping the powder material from a holder that holds the powder material while molding a compact having portions of an equal thickness on opposite sides of a through-hole by means of the holder and a die that has a lower inner disposed inside a die cavity of a die plate, the powder material being dropped from the holder and packed into the die cavity by bringing a bottom surface of the holder and an upper surface of the die plate into sliding contact with each other, with the bottom surface of the holder open, and advancing and retracting the holder over the die cavity, the method including: making a first preparation of determining in advance a relation between an advancing speed of the holder and a packing density of the powder material packed in the die cavity at each of the portions to be of an equal thickness of the compact on opposite sides of the through-hole; and, based on the relation determined in the first preparation, adjusting the advancing speed of the holder to a speed at which the packing density becomes uniform.

(2) In the powder material packing method, the first preparation may include determining in advance a relation between the advancing speed of the holder and a difference in thickness after molding between the portions to be of an equal thickness of the compact, and the adjustment may include, based on the relation determined in the first preparation, adjusting the advancing speed of the holder to a speed at which a measured difference in thickness becomes zero.

(3) In the powder material packing method, the adjustment may include applying a measured difference in thickness between the portions to be of an equal thickness of the compact that is molded with the die last time to the relation between the advancing speed of the holder and the difference in thickness after molding determined in the first preparation, to find out the advancing speed of the holder at which the difference in thickness becomes zero, and adjusting the advancing speed of the holder accordingly.

(4) The powder material packing method may further include making a second preparation of determining in advance a relation between a difference in height between the upper surface of the die plate and an upper surface of the lower inner and the difference in thickness after molding between the portions to be of an equal thickness of the compact, and the adjustment may include: applying a measured difference in height between the upper surface of the die plate and the upper surface of the lower inner to the relation between the difference in height between the upper surface of the die plate and the upper surface of the lower inner and the difference in thickness after molding between the portions to be of an equal thickness of the compact determined in the second preparation, to find out an estimated difference in thickness after molding; applying the estimated difference to the relation between the advancing speed of the holder and the difference in thickness after molding determined in the first preparation, to find out the advancing speed of the holder at which the difference in thickness becomes zero; and adjusting the advancing speed of the holder accordingly.

In the powder material packing method, the difference in thickness after molding between the portions to be of an equal thickness of the compact may be a difference in thickness between two portions of an annular compact with a through-hole that are located symmetrically on opposite sides of the through-hole.

In the powder material packing method, when a rear portion is measured to be thicker than a front portion as the measured difference in thickness of the compact, an adjustment value may be added to a current setting of the advancing speed of the holder such that the measured difference in thickness of the compact becomes zero, and when the rear portion is measured to be thinner than the front portion as the measured difference in thickness of the compact, an adjustment value may be subtracted from the current setting of the advancing speed of the holder such that the measured difference in thickness of the compact becomes zero.

In the powder material packing method, a retracting speed of the holder may be the predetermined same speed.

In the powder material packing method, the advancing speed of the holder may be constant.

In the powder material packing method, the relation between the advancing speed of the holder and the difference in thickness after molding between the portions to be of an equal thickness of the compact may be determined in the first preparation, the relation may include data on a case where a speed of the holder is changed while the holder is advancing, and the adjustment may include changing the speed of the holder while the holder is advancing.

Thus configured, the present disclosure can uniformize the packing density of a powder material and thereby improve the dimensional accuracy of a molded compact. In the first preparation, it is comparatively easy to determine the relation between the advancing speed of the holder and the difference in thickness of the compact. The packing density of the powder material can be further uniformized. Even when the molded compact is not measured, the packing density of the powder material can be further uniformized.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Figure 1:
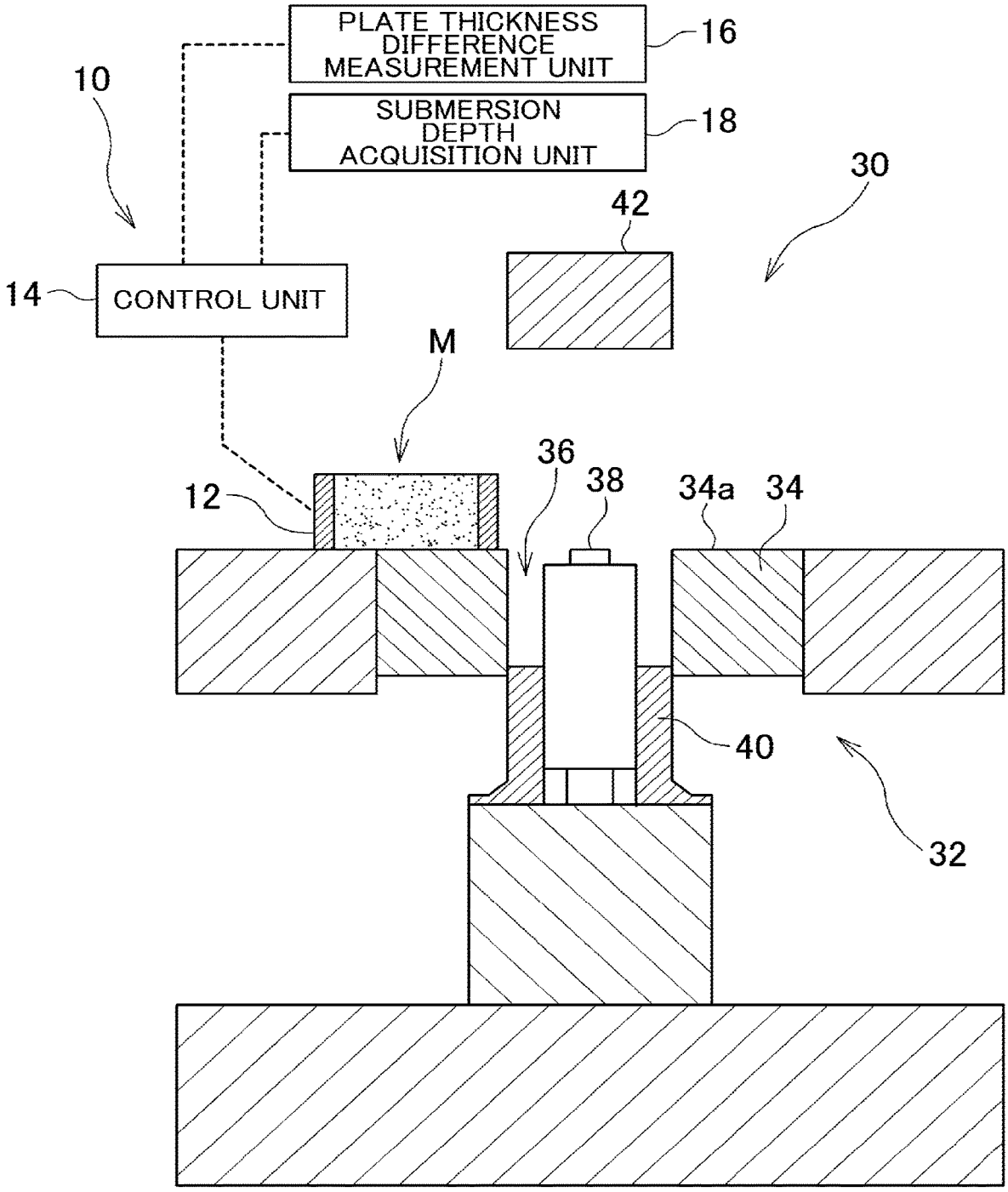
FIG. 1 is a simplified view schematically showing configurations of a powder material packing device and a die to be packed with a powder material by the packing device, both used in powder material packing methods according to embodiments of the present disclosure.

Embodiments of the present disclosure will be described below based on the drawings. Throughout the drawings, the same components or corresponding components are denoted by the same reference signs. FIG. 1 schematically shows configurations of a powder material packing device 10 and a die 30 to be packed with a powder material M by the powder material packing device 10, both used in powder material packing methods according to the embodiments of the present disclosure. The die 30 is used to mold a compact P with a through-hole Pa (see FIG. 2A) by compressing the powder material M, such as a metal powder, and in FIG. 1, the die 30 is shown in an uncompressed state before being packed with the powder material M. The die 30 is roughly composed of a die plate 34, a lower inner 38, and a lower outer 40 included in a lower die 32, and an upper punch 42 included in an upper die.

The die plate 34 and the lower outer 40 each have an annular shape, and the lower inner 38 and the upper punch 42 each have a columnar shape. In the lower die 32, a die cavity 36 is formed by an inner circumferential surface of the die plate 34, an outer circumferential surface of the lower inner 38, and an upper surface of the lower outer 40. In the die 30, the upper punch 42 is moved downward relative to the lower die 32 during compression, so that an upper side of the die cavity 36 is closed and a closed space for compressing the powder material M is formed. Heights of the die plate 34 and the lower inner 38 of the die 30 relative to each other are adjustable, and adjustment of these heights, and movement of each component according to switching between the uncompressed state and the compressed state are performed through a control mechanism etc.

The powder material packing device 10 includes a holder 12 and a control unit 14, and further includes at least one of a plate thickness difference measurement unit 16 and a submersion depth acquisition unit 18. The holder 12 has a box shape and is openable at least at a bottom surface, and holds the powder material M to be packed into the die 30. The holder 12 is installed on the die plate 34 so as to be movable at least in a left-right direction in FIG. 1 so that, under control of the control unit 14, the holder 12 passes over the die cavity 36 that is open on the upper side in the uncompressed state of the die 30. The control unit 14 controls operation of the holder 12, and advances and retracts the holder 12 (moves the holder 12 rightward and leftward in FIG. 1) relative to the opening of the die cavity 36 while bringing the holder 12 into sliding contact with the upper surface 34*a* of the die plate 34. As will be described in detail later, the control unit 14 has preset data used for adjustment of an advancing speed of the holder 12 that shows a relation between the advancing speed of the holder 12 and a difference in thickness after molding between portions to be of an equal thickness of the compact P. The control unit 14 includes, for example, a robot mechanism that moves the holder 12 and a motion controller that controls the robot mechanism.

As will be described in detail later, the plate thickness difference measurement unit 16 measures a front-rear difference in plate thickness (difference in thickness) of the molded compact P, and the submersion depth acquisition unit 18 acquires a submersion depth H (see FIG. 4) set for the die 30. The plate thickness difference measurement unit 16 is a laser displacement meter, for example, and sends a measurement result to the control unit 14. The submersion depth acquisition unit 18 acquires the submersion depth H from the control mechanism of the die 30 etc. and sends the acquired submersion depth H to the control unit 14. Provided that a connection between the control unit 14 and the control mechanism of the die 30 etc. is established, the submersion depth acquisition unit 18 may be incorporated in the control unit 14. The dashed lines shown in FIG. 1 mean that a connection that allows sending and receiving of data and control signals is established between the control unit 14 and each of the holder 12, the plate thickness difference measurement unit 16, and the submersion depth acquisition unit 18.

Figure 2A:
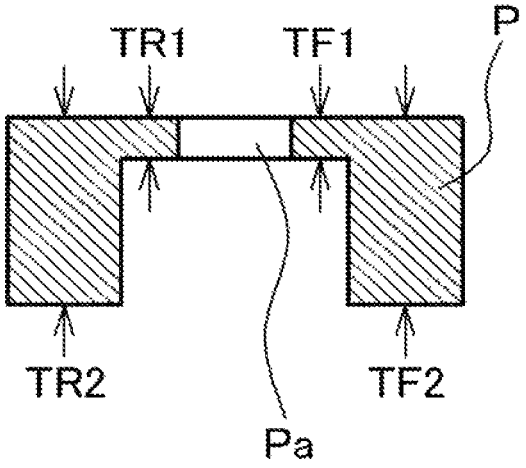
FIG. 2A is a view related to the powder material packing method according to a first embodiment of the present disclosure, showing that the powder material is compressed to form a compact with a through-hole.
Figure 2B:
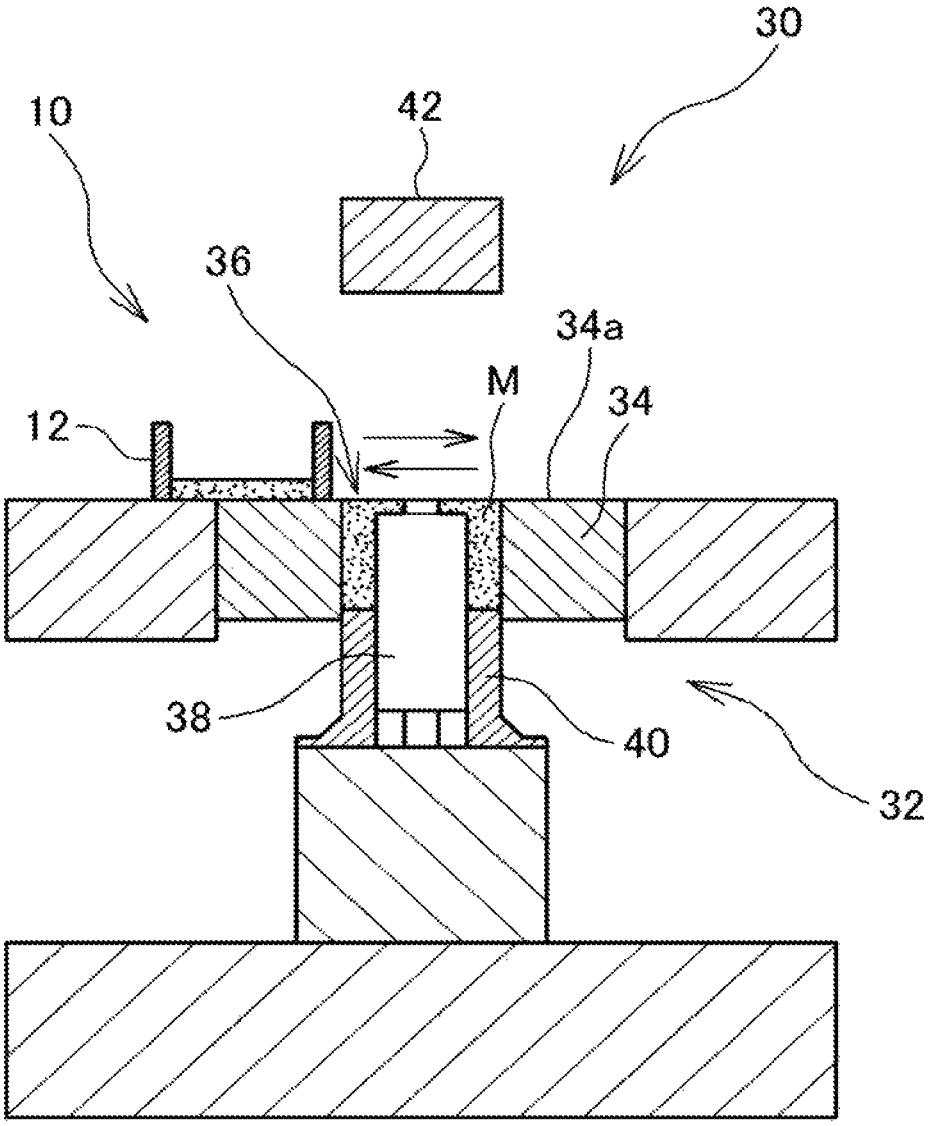
FIG. 2B is a simplified view illustrating the powder material packing method according to the first embodiment of the present disclosure.

Next, the powder material packing method according to a first embodiment of the present disclosure that is performed using the powder material packing device 10 shown in FIG. 1 will be described with reference to FIG. 2. In FIG. 2, the control unit 14, the plate thickness difference measurement unit 16, etc. included in the powder material packing device 10 are not shown. First, main points of the powder material packing methods according to the embodiments (including the first embodiment and a second embodiment to be described later) of the present disclosure will be described. In the powder material packing methods according to the embodiments of the present disclosure, the powder material M is dropped from the holder 12 and packed into the die cavity 36 by advancing and retracting the holder 12 relative to the opening of the die cavity 36 as shown in FIG. 2B. The powder material M is fed from the holder 12 to the die cavity 36 mainly while the holder 12 is advancing. Characteristically, advancing the holder 12 at a comparatively high advancing speed results in the powder material M having a high packing density on the front side (right side in FIG. 2B), and advancing the holder 12 at a comparatively low advancing speed results in the powder material M having a high packing density on the rear side (left side in FIG. 2B). This is due to an inertial force of the powder material M inside the holder 12 moving along with the holder 12.

Figure 4:
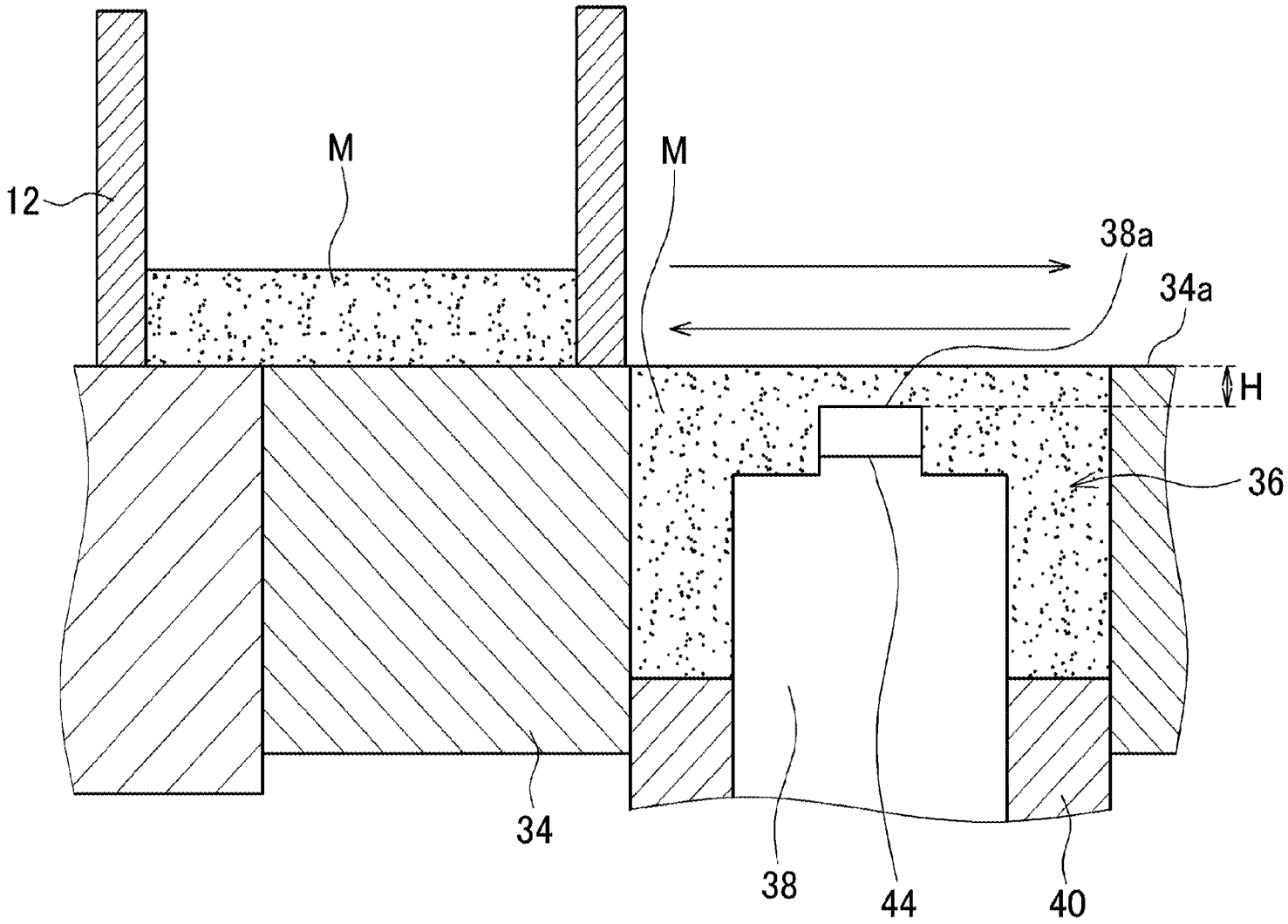
FIG. 4 is an enlarged simplified view showing a state where a powder material is packed in a cavity of a die.

On the other hand, if an amount of packing (packing depth) of the powder material M in the die 30 is adjusted to produce the compact P with a desired packing density, the submersion depth H is left between the die plate 34 and the lower inner 38 as shown in FIG. 4. In particular, if the holder 12 is advanced and retracted while there is the submersion depth H, a part, located on the upper side in FIG. 4, of the powder material M fed in the die cavity 36 by the advancing holder 12 is dragged to the rear side by the retracting holder 12. As a result, the packing density of the powder material M in the die cavity 36 after the holder 12 is retracted tends to be low on the front side (right side in FIG. 4) and high on the rear side (left side in FIG. 4) compared with the packing density before the holder 12 is retracted.

Taking advantage of the characteristic due to the inertial force of the powder material M, the powder material packing methods according to the embodiments of the present disclosure adjust the advancing speed of the holder 12 so as to cause a front-rear difference in the packing density of the powder material M in the die cavity 36 after the holder 12 is advanced. Specifically, if the packing density tends to be low on the front side and high on the rear side as the powder material M is dragged to the rear side by the retracting holder 12, the advancing speed of the holder 12 is adjusted with the tendency taken into account so that the packing density of the powder material M on the front side becomes high in advance. The component indicated by reference sign 44 in FIG. 4 is a packing adjustment spacer that is installed on an upper side of the lower inner 38 to cope with changes in packing depth to which the powder material M is packed. In a case where the packing adjustment spacer 44 is installed, the submersion depth H is left with an upper surface of the packing adjustment spacer 44 regarded as the upper surface 38*a* of the lower inner 38.

Specifically, to adjust the advancing speed of the holder 12, in a preparation step of the powder material packing methods according to the embodiments of the present disclosure, a relation between the advancing speed of the holder 12 and a front-rear difference in plate thickness of the molded compact P is acquired, and data showing the acquired relation is set in the control unit 14 of the powder material packing device 10. The front-rear difference in plate thickness of the compact P refers to a difference in thickness after molding between the portions to be of an equal thickness of the compact P, in which the through-hole Pa is formed, that are located on opposite sides of the through-hole Pa. Specifically, in the annular compact P with the through-hole Pa shown in FIG. 2A, the front-rear difference in plate thickness of the compact P refers to a difference in thickness between two portions indicated by reference signs TF1, TR1, or a difference in thickness between two portions indicated by reference signs TF2, TR2, that are located symmetrically on opposite sides of the through-hole Pa.

Thus, the portion TF1 and the portion TR1 are portions that are located on opposite sides of the through-hole Pa and to be of an equal thickness according to design dimensions of the compact P. The same applies for a relation between the portion TF2 and the portion TR2. The relation between the advancing speed of the holder 12 and the front-rear difference in plate thickness of the compact P is acquired by changing the advancing speed of the holder 12 to a plurality of speeds and measuring the front-rear difference in plate thickness between these portions of the compact P that is molded at each speed. Here, regardless of the advancing speed, a retracting speed is the predetermined same speed. In the preparation step, the data showing the relation thus acquired is preset in the control unit 14.

In the powder material packing method according to the first embodiment of the present disclosure, a plate thickness front-rear difference measurement step, an adjustment step, and a packing step are performed after the above preparation step. In the plate thickness front-rear difference measurement step, as shown in FIG. 2A, the front-rear difference in plate thickness of the compact P that is molded with the die 30 last time (last-time front-rear difference in plate thickness) is measured using the plate thickness difference measurement unit 16 (see FIG. 1). Here, in the case of the compact P shown in FIG. 2A, the two portions to be measured for the last-time front-rear difference in plate thickness may be the thin portions TF1, TR1 or the thick portions TF2, TR2. In either case of combination, the two portions are portions to be of an equal thickness of the compact P that are located on opposite sides of the through-hole Pa. In the following, the case where the front-rear difference in plate thickness between the thin portions TF1, TR1 is measured as the last-time front-rear difference in plate thickness of the compact P will be described as an example. The measured last-time front-rear difference in plate thickness of the compact P is sent from the plate thickness difference measurement unit 16 to the control unit 14. This step of measuring the front-rear difference in plate thickness of the compact P that is performed using the plate thickness difference measurement unit 16 can be incorporated as a part of a process performed in a manufacturing line for manufacturing a product produced from the compact P.

Next, in the adjustment step, the control unit 14 calculates the advancing speed of the holder 12 based on the measured last-time front-rear difference in plate thickness of the compact P sent from the plate thickness difference measurement unit 16, and on the data showing the relation between the advancing speed of the holder 12 and the front-rear difference in plate thickness of the compact P that is preset in the control unit 14 in the preparation step. Specifically, the measured last-time front-rear difference in plate thickness of the compact P is applied to the relation between the advancing speed of the holder 12 and the front-rear difference in plate thickness of the compact P, to calculate an adjustment value for the advancing speed of the holder 12 such that the measured last-time front-rear difference in plate thickness of the compact P becomes zero. Then, for example, if the rear portion TR1 is measured to be thicker than the front portion TF1 by the measured difference x in thickness as the measured last-time front-rear difference in plate thickness of the compact P, an adjustment value is added to a current setting of the advancing speed of the holder 12 such that the measured difference x in thickness of the compact becomes zero. Specifically, the setting of the advancing speed of the holder 12 is changed to a speed higher than the advancing speed at which the powder material M is fed to mold the compact P last time.

Conversely, if the rear portion TR1 is measured to be thinner than the front portion TF1 by the measured difference y in thickness as the measured last-time front-rear difference in plate thickness of the compact P, an adjustment value is subtracted from the current setting of the advancing speed of the holder 12 such that the measured difference y in thickness of the compact becomes zero. Specifically, the setting of the advancing speed of the holder 12 is changed to a speed lower than the advancing speed at which the powder material M is fed to mold the compact P last time. However, if the measured last-time front-rear difference in plate thickness between the front portion TF1 and the rear portion TR1 of the compact P molded last time is substantially zero, the current setting of the advancing speed of the holder 12 is maintained as is.

Next, in the packing step, as shown in FIG. 2B, the control unit 14 controls operation of the holder 12 so that the holder 12, with the bottom surface open, is advanced and retracted relative to the opening of the die cavity 36 while being brought into sliding contact with the upper surface 34*a* of the die plate 34. Here, a direction in which the holder 12 is advanced and retracted is such a direction that portions of the die cavity 36 corresponding to the portions to be of an equal thickness of the compact P are disposed on the front side and the rear side of the lower inner 38 in the advancing direction of the holder 12. The advancing speed of the holder 12 is the speed that is calculated, as described above, based on the measured last-time front-rear difference in plate thickness of the compact P and on the data showing the relation between the advancing speed of the holder 12 and the front-rear difference in plate thickness of the compact P. The retracting speed of the holder 12 is a predetermined constant speed. Thus, the powder material M held in the holder 12 is packed into the die cavity 36 of the die 30. In the state shown in FIG. 2B, as in the state shown in FIG. 4, the submersion depth H is left between the die plate 34 and the lower inner 38 as a result of the packing depth of the powder material M in the die 30 being adjusted to produce the compact P with a desired packing density.

Figure 2C:
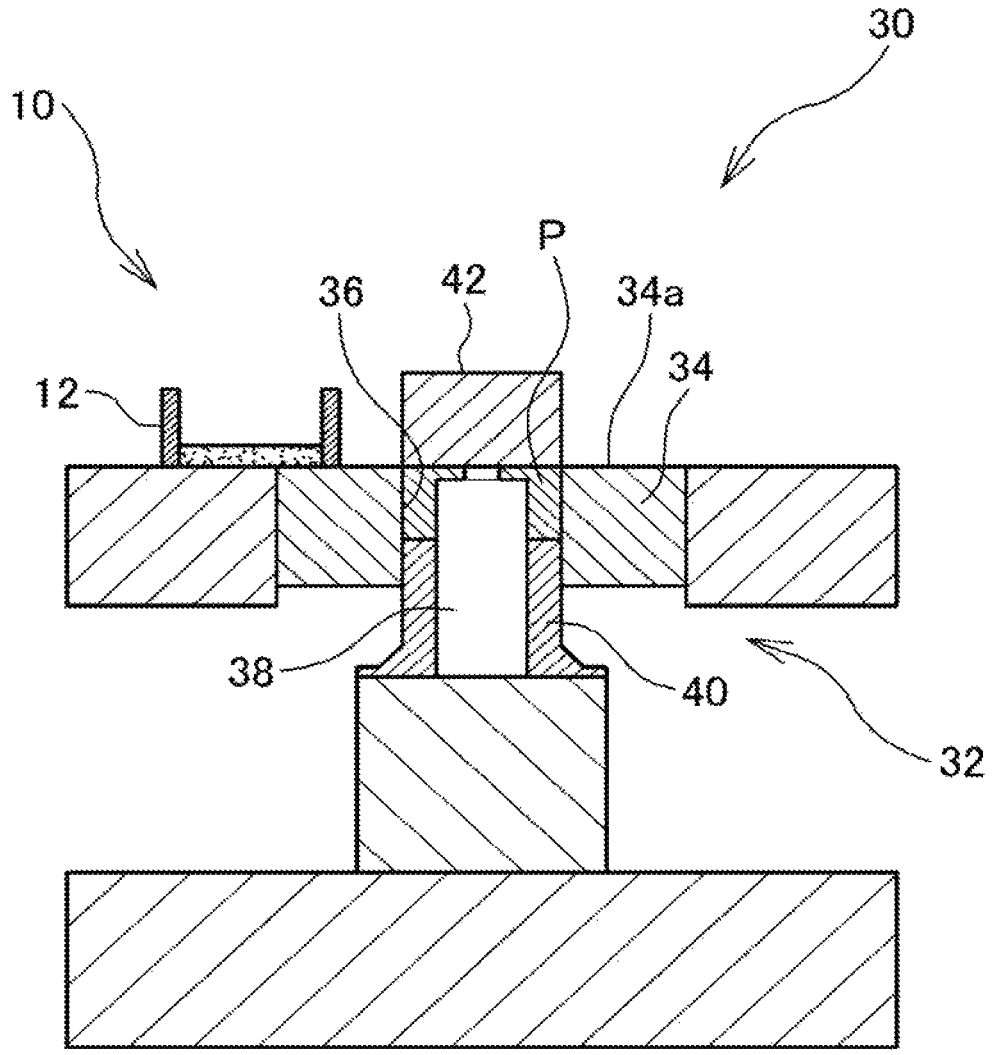
FIG. 2C is a simplified view illustrating the powder material packing method according to the first embodiment of the present disclosure.

Thereafter, the powder material M is compressed by the die 30 to mold the compact P as shown in FIG. 2C. Then, the compact P is removed from the die 30, and after weight measurement, deburring, etc. of the compact P are performed, a front-rear difference in plate thickness of the molded compact P is measured as shown in FIG. 2A to use the measurement result for adjusting the advancing speed at which the powder material M will be packed into the die cavity 36 next time. Subsequently, the plate thickness front-rear difference measurement step, the adjustment step, and the packing step, which are included in the powder material packing method according to the first embodiment of the present disclosure, and compression of the compact P by the die 30 are performed repeatedly. Thus, in the powder material packing method according to the first embodiment of the present disclosure, the front-rear difference in plate thickness of the compact P molded last time is fed back, and the advancing speed of the holder 12 when feeding the powder material M is adjusted accordingly so as to zero the front-rear difference in plate thickness of the compact P to be molded next time. In a case where the front-rear difference in plate thickness of the compact P molded last time cannot be measured due to equipment being at start of operation etc., for example, first an initial setting of the advancing speed can be temporarily used to advance the holder 12, and subsequently the measured last-time front-rear difference in plate thickness of the compact P can be used.

Next, the powder material packing method according to the second embodiment of the present disclosure, which is different from that of the embodiment described with reference to FIG. 2, will be described with reference to FIG. 3. In FIG. 3, the control unit 14 and the submersion depth acquisition unit 18 included in the powder material packing device 10 are not shown. Compared with the powder material packing method according to the first embodiment of the present disclosure, the powder material packing method according to the second embodiment of the present disclosure further includes a second preparation step, and includes a submersion depth acquisition step instead of the plate thickness front-rear difference measurement step. Thus, in the powder material packing method according to the second embodiment of the present disclosure, the preparation step, the second preparation step, the submersion depth acquisition step, the adjustment step, and the packing step are performed.

In the second preparation step, a relation between the submersion depth H and the front-rear difference in plate thickness of the compact P is acquired, and data showing the acquired relation is set in the control unit 14 of the powder material packing device 10. Specifically, the relation between the submersion depth H and the front-rear difference in plate thickness of the compact P is acquired by packing the powder material M and molding the compact P with the submersion depth H set to a plurality of predetermined depths, and measuring the front-rear difference in plate thickness of the compact P at each predetermined submersion depth H. Here, the advancing speed and the retracting speed of the holder 12 are respectively predetermined constant speeds. In the second preparation step, the data showing the relation thus acquired is preset in the control unit 14.

Figure 3A:
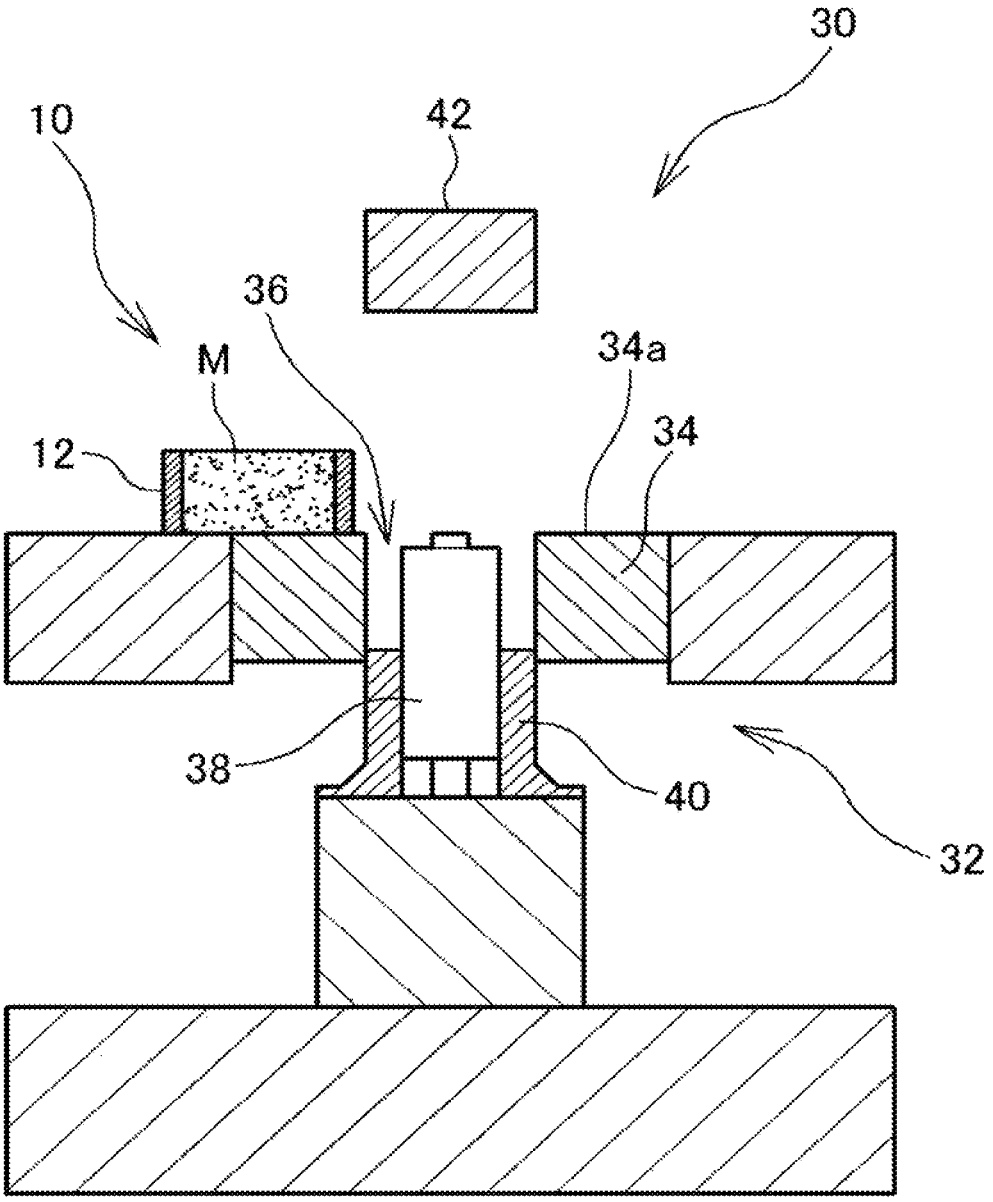
FIG. 3A is a simplified view illustrating the powder material packing method according to a second embodiment of the present disclosure.

In the powder material packing method according to the second embodiment of the present disclosure, the submersion depth acquisition step is performed after the preparation step and the second preparation step. In the submersion depth acquisition step, as shown in FIG. 3A, the die 30 is moved to a position reflecting a packing depth that meets an amount of packing of the powder material M to produce the compact P with a desired packing density. As a result, the submersion depth H as shown in FIG. 4 is left between the upper surface 34*a* of the die plate 34 and the upper surface 38*a* of the lower inner 38 in the die 30. The submersion depth H is acquired as the measured submersion depth H by the submersion depth acquisition unit 18 (see FIG. 1). The measured submersion depth H is a difference in height between the die plate 34 and the lower inner 38, and therefore can be acquired, for example, from the control mechanism of the die 30 that controls the positions of the two. Then, the acquired measured submersion depth H is sent from the submersion depth acquisition unit 18 to the control unit 14.

Next, in the adjustment step, the control unit 14 calculates an estimated front-rear difference in plate thickness of the compact P based on the measured submersion depth H sent from the submersion depth acquisition unit 18 and on the data showing the relation between the submersion depth H and the front-rear difference in plate thickness of the compact P that is preset in the control unit 14. Specifically, the measured submersion depth H is applied to the relation between the submersion depth H and the front-rear difference in plate thickness of the compact P, to calculate an estimated front-rear difference in plate thickness of the compact P that is estimated to occur when the powder material M is packed and the compact P is molded with a current setting of the submersion depth H in the die 30. Then, the advancing speed of the holder 12 is calculated based on the calculated estimated front-rear difference in plate thickness and on the data showing the relation between the advancing speed of the holder 12 and the front-rear difference in plate thickness of the compact P that is preset in the control unit 14. Specifically, the estimated front-rear difference in plate thickness estimated from the measured submersion depth H is applied to the relation between the advancing speed of the holder 12 and the front-rear difference in plate thickness of the compact P, to calculate the advancing speed of the holder 12 such that the estimated front-rear difference in plate thickness of the compact P becomes zero.

For example, if the rear portion TR1 is estimated to be thicker than the front portion TF1 by measured difference x in thickness as the estimated front-rear difference in plate thickness of the compact P, a comparatively high advancing speed is calculated such that the measured difference x in thickness of the compact becomes zero using the relation between the advancing speed of the holder 12 and the front-rear difference in plate thickness of the compact P. Conversely, if the rear portion TR1 is estimated to be thinner than the front portion TF1 by the measured difference y in thickness as the estimated front-rear difference in plate thickness of the compact P, a comparatively low advancing speed is calculated such that the measured difference y in thickness of the compact becomes zero using the relation between the advancing speed of the holder 12 and the front-rear difference in plate thickness of the compact P. However, if the estimated front-rear difference in plate thickness of the compact P is substantially zero, for example, the constant advancing speed of the holder 12 is calculated that is set in the second preparation step when the relation between the submersion depth H and the front-rear difference in plate thickness of the compact P is acquired.

Figure 3B:
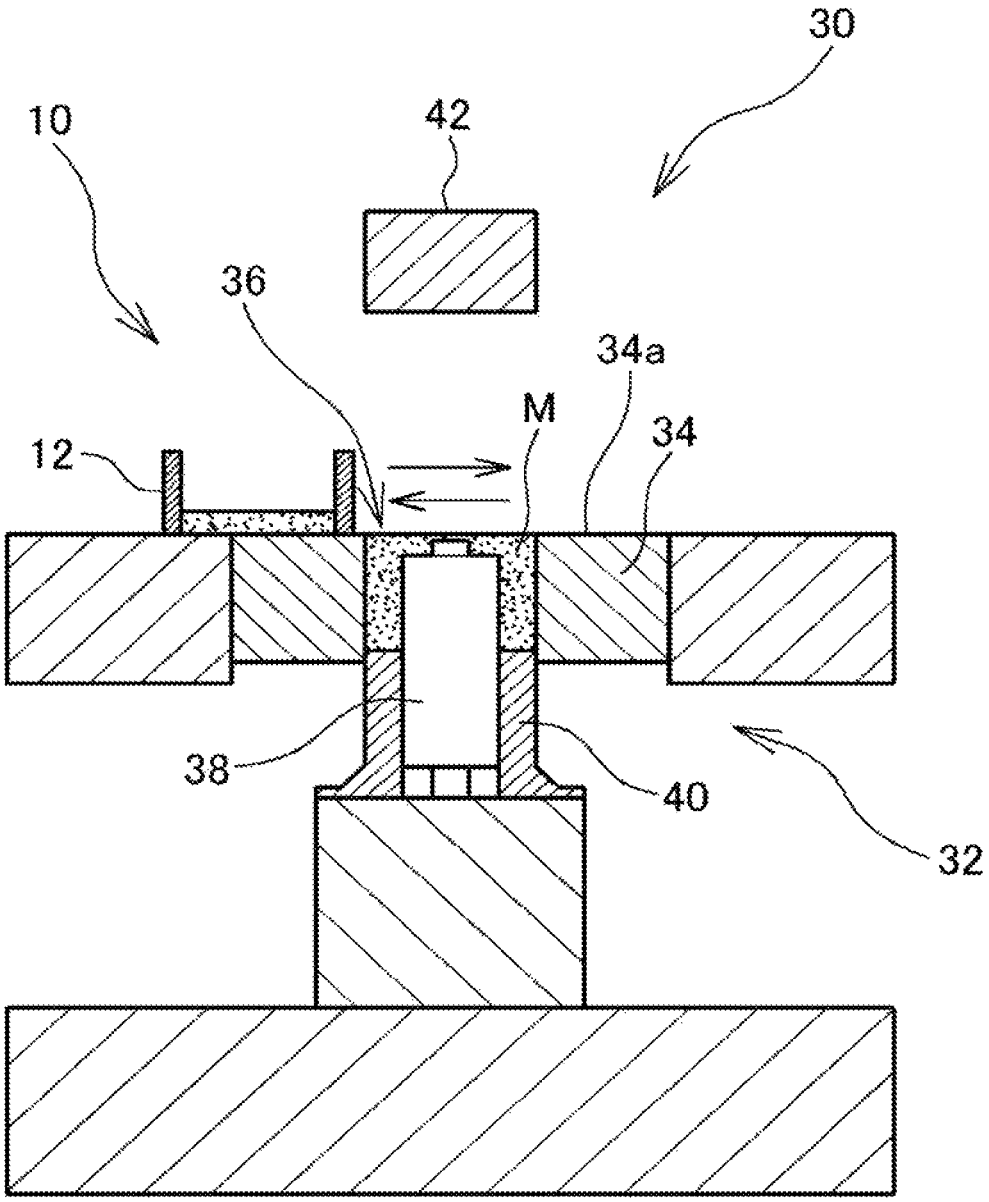
FIG. 3B is a simplified view illustrating the powder material packing method according to the second embodiment of the present disclosure.

Next, in the packing step, as shown in FIG. 3B, the control unit 14 controls operation of the holder 12 so that the holder 12, with the bottom surface open, is advanced and retracted relative to the opening of the die cavity 36 while being brought into sliding contact with the upper surface 34*a* of the die plate 34. Here, a direction in which the holder 12 is advanced and retracted is such a direction that the portions of the die cavity 36 corresponding to the portions to be of an equal thickness of the compact P are located on the front side and the rear side of the lower inner 38 in the advancing direction of the holder 12. The advancing speed of the holder 12 is the speed that is calculated, as described above, based on the estimated front-rear difference in plate thickness of the compact P estimated from the current submersion depth H and on the data showing the relation between the advancing speed of the holder 12 and the front-rear difference in plate thickness of the compact P. The retracting speed of the holder 12 is a predetermined constant speed. Thus, the powder material M held in the holder 12 is packed into the die cavity 36 of the die 30. Thereafter, the powder material M is compressed by the die 30 to mold the compact P as shown in FIG. 2A.

Thus, in the powder material packing method according to the second embodiment of the present disclosure, from the current setting of the submersion depth H in the die 30, the estimated front-rear difference in plate thickness of the compact P that will occur if the compact P is molded with that submersion depth H is estimated, and the advancing speed of the holder 12 when feeding the powder material M is adjusted so as to zero the estimated front-rear difference in plate thickness. In the above-described powder material packing methods according to the first and second embodiments of the present disclosure, the holder 12 is advanced at the constant speed calculated by the control unit 14. Alternatively, the speed of the holder 12 may be changed according to circumstances while the holder 12 is advancing. In this case, more detailed data, such as data including a case where the speed of the holder 12 is changed while the holder 12 is advancing, may be acquired as the data showing the relation between the advancing speed of the holder 12 and the front-rear difference in plate thickness of the compact P determined in the preparation step.

The embodiments of the present disclosure thus configured can offer the following advantages. Specifically, the powder material packing methods according to the first and second embodiments of the present disclosure are methods for packing the powder material M, which is a material of the compact P, into the die cavity 36 of the die plate 34 of the die 30 used for molding the compact P by means of the powder material packing device 10 as shown in FIG. 1. The lower inner 38 is disposed in the die cavity 36 of the die 30 to be packed. As shown in FIG. 2A, the compact P molded with the die 30 has the through-hole Pa, corresponding to the lower inner 38, and the portions TF1, TR1 (TF2, TR2) of an equal thickness on opposite sides of the through-hole Pa. Accordingly, the die cavity 36 of the die 30 has portions located on opposite sides of the lower inner 38 that correspond to the portions TF1, TR1 of an equal thickness of the compact P on opposite sides of the through-hole Pa.

To pack the powder material M into the die cavity 36, the holder 12 holding the powder material M is brought into sliding contact with the upper surface 34*a* of the die plate 34, with the bottom surface of the holder 12 open, and advanced and retracted over the die cavity 36 so as to drop the powder material M from the holder 12 into the die cavity 36. Here, the direction in which the holder 12 is advanced and retracted is such a direction that the portions of the die cavity 36 corresponding to the portions TF1, TR1 to be of an equal thickness of the compact P are disposed on the front side and the rear side of the lower inner 38 in the advancing direction of the holder 12.

The powder material packing methods according to the first and second embodiments of the present disclosure include the preparation step and the adjustment step. In the preparation step, the relation between the advancing speed of the holder 12 and the packing density of the powder material M packed in the die cavity 36 at each of the portions TF1, TR1 to be of an equal thickness of the compact P on opposite sides of the through-hole Pa is determined in advance. As described above, the die cavity 36 of the die 30 used to mold the compact P has the portions corresponding to the portions TF1, TR1 to be of an equal thickness of the compact P on opposite sides of the through-hole Pa. In the preparation step, therefore, the relation between the advancing speed of the holder 12 and the packing density of the powder material M that is packed at the portions of the die cavity 36 corresponding to the portions TF1, TR1 to be of an equal thickness of the compact P on opposite sides of the through-hole Pa is determined.

In the adjustment step, based on the relation determined in the preparation step, the advancing speed of the holder 12 when packing the powder material M into the die cavity 36 is adjusted to a speed at which the packing density becomes uniform. Here, as the powder material M drops from the holder 12 and is packed into the die cavity 36 mainly while the holder 12 is advancing, a difference in packing density occurs between the front side and the rear side of the die cavity 36 according to the advancing speed of the holder 12 due to the influence of the inertial force of the powder material M advancing along with the holder 12. To describe this specifically with reference to FIG. 4, characteristically, advancing the holder 12 (moving the holder 12 rightward in FIG. 4) at a comparatively high speed results in the powder material M packed on the front side (right side in FIG. 4) of the die cavity 36 having a high packing density. Conversely, advancing the holder 12 at a comparatively low speed results in the powder material M packed on the rear side (left side in FIG. 4) of the die cavity 36 having a high packing density.

On the other hand, powder materials M of different manufacturing lots etc. can have different densities even before being packed into the die cavity 36. To mold the compact P with a predetermined packing density, therefore, the packing depth of the powder material M in the die cavity 36 is adjusted by adjusting the height of the die plate 34 according to the density of the powder material M. As a result, a difference in height (submersion depth) H is left between the upper surface 34*a* of the die plate 34 and the upper surface 38*a* of the lower inner 38. In particular, if the powder material M is packed while there is the difference in height H, a part of the powder material M packed in the die cavity 36 by the advancing holder 12 is dragged to the rear side by the retracting holder 12. Accordingly, the packing density of the powder material M in the die cavity 36 after the holder 12 is retracted tends to be low on the front side and high on the rear side compared with the packing density immediately after the holder 12 is advanced. Such a front-rear difference in packing density also occurs between the portions of the powder material M packed in the die cavity 36 that correspond to the portions TF1, TR1 to be of an equal thickness of the compact P on opposite sides of the through-hole Pa.

In the adjustment step, therefore, the advancing speed of the holder 12 is adjusted based on the relation determined in the preparation step so that such a front-rear difference in packing density as offsets the front-rear difference in packing density of the powder material M estimated to occur when the holder 12 is retracted occurs when the holder 12 is advanced. Specifically, if the packing density of the powder material M after the holder 12 is retracted is estimated to be higher on the rear side than the front side of the die cavity 36, the holder 12 is advanced at a comparatively high speed to pack the powder material M so that the packing density becomes higher on the front side than the rear side in advance. Conversely, if the packing density of the powder material M after the holder 12 is retracted is estimated to be higher on the front side than the rear side of the die cavity 36, the holder 12 is advanced at a comparatively low speed to pack the powder material M so that the packing density becomes higher on the rear side than the front side in advance.

In this way, even when the packing depth in the die 30 is adjusted according to variations in density of the powder material M, the front-rear difference in packing density that is intentionally caused when the holder 12 is advanced and the front-rear difference in packing density that is estimated to occur when the holder 12 is retracted can offset each other. It is therefore possible to uniformize the packing density of the powder material M packed at the portions of the die cavity 36 corresponding to the portions TF1, TR1 to be of an equal thickness of the compact P on opposite sides of the through-hole Pa. Moreover, molding the powder material M thus packed at a uniform packing density can improve the dimensional accuracy of the molded compact P. Furthermore, the improvement in dimensional accuracy of the compact P translates into reduction in material defects and processing defects, reduction in adjustment man-hours involving shutdown of the equipment, and increase in ratio of utilization of the equipment.

In the preparation step of the powder material packing methods according to the first and second embodiments of the present disclosure, the relation between the advancing speed of the holder 12 and the difference in thickness (front-rear difference in plate thickness) after molding between the portions TF1, TR1 to be of an equal thickness of the compact P is determined in advance. Thus, the difference in thickness between the portions TF1, TR1 to be of an equal thickness of the molded compact P resulting from the difference in packing density therebetween is used as the difference in packing density of the powder material M packed in the die cavity 36 between the portions TF1, TR1 to be of an equal thickness of the compact P on opposite sides of the through-hole Pa. It is easy to determine the relation between the advancing speed of the holder 12 and the difference in thickness between the portions TF1, TR1 to be of an equal thickness of the molded compact P, because the latter is easier to measure than the packing density of the powder material M packed in the die cavity 36.

In the adjustment step of the powder material packing methods according to the first and second embodiments of the present disclosure, based on the relation determined in the preparation step, the advancing speed of the holder 12 is adjusted to a speed at which the measured difference in thickness (measured front-rear difference in plate thickness) becomes zero. Here, to zero the measured difference in thickness after molding between the portions TF1, TR1 to be of an equal thickness of the compact P, it is necessary to pack the powder material M at a uniform packing density at the portions of the die cavity 36 that correspond to the portions TF1, TR1 to be of an equal thickness of the compact P disposed on the front side and the rear side in the advancing direction of the holder 12. Accordingly, if the advancing speed of the holder 12 is adjusted so as to zero the difference in thickness between the portions TF1, TR1 to be of an equal thickness of the molded compact P, the powder material M can be packed at a uniform packing density on the front side and the rear side of the die cavity 36 in the advancing direction of the holder 12. Thus, the powder material M can be packed into the die cavity 36 at a uniform packing density, and the dimensional accuracy of the molded compact P can be improved by molding the powder material M packed at a uniform packing density.

In the powder material packing method according to the first embodiment of the present disclosure, as shown in FIG. 2, the compact P molded with the die 30 last time is measured before the powder material M is packed, to acquire the measured difference in thickness between the portions TF1, TR1 to be of an equal thickness of the compact P molded last time (measured last-time front-rear difference in plate thickness). Then, in the adjustment step, the measured difference in thickness of the compact P molded last time is applied to the relation between the advancing speed of the holder 12 and the difference in thickness of the molded compact P determined in the preparation step, to find out the advancing speed of the holder 12 at which the difference in thickness becomes zero. Thus, the measured difference in thickness of the compact P molded last time is fed back and used as the difference in thickness to be applied to the relation determined in the preparation step, to find out the advancing speed of the holder 12 at which the difference in thickness becomes zero and adjust the advancing speed of the holder 12 accordingly. In this way, the difference in thickness of the compact P molded last time can be factored into adjustment of the advancing speed of the holder 12 when packing the powder material M next time, which makes it possible to further uniformize the packing density of the powder material M packed in the die cavity 36.

On the other hand, the powder material packing method according to the second embodiment of the present disclosure includes the second preparation step of determining in advance the relation between the difference in height (submersion depth) H between the upper surface 34*a* of the die plate 34 and the upper surface 38*a* of the lower inner 38 and the difference in thickness after molding between the portions TF1, TR1 to be of an equal thickness of the compact P. As described above, if the height of the die plate 34 is adjusted according to the density of the powder material M to mold the compact P with a predetermined packing density, the difference in height H is left between the upper surface 34*a* of the die plate 34 and the upper surface 38*a* of the lower inner 38 as shown in FIG. 4. Moreover, for example, if the advancing speed and the retracting speed of the holder 12 are respectively set to predetermined speeds, the difference in thickness of the compact P packed and molded in this state tends to increase as the difference in height H increases. The second preparation step determines in advance such a relation between the difference in height H between the die plate 34 and the lower inner 38 and the difference in thickness after molding of the compact P.

In the powder material packing method according to the second embodiment of the present disclosure, as shown in FIG. 3, the difference in height (submersion depth) H between the upper surface 34*a* of the die plate 34 and the upper surface 38*a* of the lower inner 38 is measured before the powder material M is packed. As the height of the die plate 34 and the height of the lower inner 38 are set in the die 30 to mold the compact P with a predetermined packing density, the difference in height H therebetween can be easily acquired from the control mechanism of the die 30 etc. Then, in the adjustment step, the measured difference in height H is applied to the relation between the difference in height between the die plate 34 and the lower inner 38 and the difference in thickness after molding of the compact P determined in the second preparation step, to find out the estimated difference in thickness after molding (estimated front-rear difference in plate thickness). In other words, the current setting of the difference in height H in the die 30 between the upper surface 34*a* of the die plate 34 and the upper surface 38*a* of the lower inner 38 is applied to the relation determined in the second preparation step. Thus, the estimated difference in thickness of the compact P that will occur if the powder material M is packed and the compact P is molded with the current setting of the difference in height H is calculated.

The calculated estimated difference in thickness of the compact P is then applied to the relation between the advancing speed of the holder 12 and the difference in thickness after molding of the compact P determined in the preparation step, to find out the advancing speed of the holder 12 at which the difference in thickness becomes zero. Thus, the estimated difference in thickness of the compact P that is estimated from the current setting of the difference in height H between the die plate 34 and the lower inner 38 is used as the difference in thickness to be applied to the relation determined in the preparation step, to find out the advancing speed of the holder 12 at which the difference in thickness becomes zero and adjust the advancing speed of the holder 12 accordingly. In this way, it is possible to adjust the advancing speed of the holder 12 so as to zero the difference in thickness of the compact P without using the measured difference in thickness thereof. Accordingly, even when the molded compact P is not measured, the packing density of the powder material M packed in the die cavity 36 can be further uniformized.

The following items describe the disclosure of the present application expressed as a powder material packing device, like the one shown in FIG. 1, in keeping with the gist of the disclosure. (5) A device that packs a powder material into a die cavity by dropping the powder material from a holder in molding a compact having portions of an equal thickness on opposite sides of a through-hole by means of a die that has a lower inner disposed inside a die cavity of a die plate and the holder that holds the powder material, the powder material being dropped from the holder and packed into the die cavity by bringing an upper surface of the die plate and a bottom surface of the holder into sliding contact with each other, with the bottom surface of the holder open, and advancing and retracting the bottom surface of the holder over the die cavity, the device including the holder and a control unit that controls operation of the holder, wherein, based on a preset relation between an advancing speed of the holder and a packing density of the powder material packed in the die cavity at each of the portions to be of an equal thickness of the compact on opposite sides of the through-hole, the control unit adjusts the advancing speed of the holder to a speed at which the packing density becomes uniform.

(6) The powder material packing device according to item (5), wherein the control unit adjusts the advancing speed of the holder to a speed at which a measured difference in thickness after molding between the portions to be of an equal thickness of the compact becomes zero, based on a preset relation between the advancing speed of the holder and a difference in thickness after molding between the portions to be of an equal thickness of the compact as the relation between the advancing speed of the holder and the packing density of the powder material packed in the die cavity at each of the portions to be of an equal thickness of the compact on opposite sides of the through-hole. (7) The powder material packing device according to item (6), further including a plate thickness difference measurement unit that measures a difference in thickness between the portions to be of an equal thickness of the compact molded with the die, wherein the control unit applies a measured difference in thickness between the portions to be of an equal thickness of the compact molded with the die last time that is acquired from the plate thickness difference measurement unit to the relation between the advancing speed of the holder and the difference in thickness after molding, to find out the advancing speed of the holder at which the difference in thickness becomes zero, and adjusts the advancing speed of the holder accordingly.

(8) The powder material packing device according to item (6), further including a submersion depth acquisition unit that acquires from the die a difference in height between the upper surface of the die plate and an upper surface of the lower inner, wherein the control unit applies a difference in height between the upper surface of the die plate and the upper surface of the lower inner acquired from the submersion depth acquisition unit to a preset relation between the difference in height between the upper surface of the die plate and the upper surface of the lower inner and the difference in thickness after molding between the portions to be of an equal thickness of the compact, to find out an estimated difference in thickness after molding; applies the estimated difference to the relation between the advancing speed of the holder and the difference in thickness after molding, to find out the advancing speed of the holder at which the difference in thickness becomes zero; and adjusts the advancing speed of the holder accordingly. It can be understood that these powder material packing devices according to items (5) to (8) can achieve advantages equivalent to those of the above-described powder material packing methods according to the first and second embodiments of the present disclosure.

What is claimed is:

1. A method for packing a powder material into a die cavity by dropping the powder material from a holder that holds the powder material while molding a compact having portions of an equal thickness on opposite sides of a through-hole by means of the holder and a die that has a lower inner disposed inside a die cavity of a die plate, the powder material being dropped from the holder and packed into the die cavity by bringing an upper surface of the die plate and a bottom surface of the holder into sliding contact with each other, with the bottom surface of the holder open, and advancing and retracting the holder over the die cavity, the method comprising:

making a first preparation of determining in advance a relation between an advancing speed of the holder and a packing density of the powder material packed in the die cavity at each of the portions to be of an equal thickness of the compact on opposite sides of the through-hole; and based on the relation determined in the first preparation, adjusting the advancing speed of the holder to a speed at which the packing density becomes uniform.

2. The method for packing a powder material into a die cavity according to claim 1, wherein the first preparation includes determining in advance a relation between the advancing speed of the holder and a difference in thickness after molding between the portions to be of an equal thickness of the compact, and the adjustment includes, based on the relation determined in the first preparation, adjusting the advancing speed of the holder to a speed at which a measured difference in thickness becomes zero.

3. The method for packing a powder material into a die cavity according to claim 2, wherein the adjustment includes applying a measured difference in thickness between the portions to be of an equal thickness of the compact that is molded with the die last time to the relation between the advancing speed of the holder and the difference in thickness after molding determined in the first preparation, to find out the advancing speed of the holder at which the difference in thickness becomes zero, and adjusting the advancing speed of the holder accordingly.

4. The method for packing a powder material into a die cavity according to claim 2, further comprising making a second preparation of determining in advance a relation between a difference in height between the upper surface of the die plate and an upper surface of the lower inner and the difference in thickness after molding between the portions to be of an equal thickness of the compact, wherein the adjustment includes:

applying a measured difference in height between the upper surface of the die plate and the upper surface of the lower inner to the relation between the difference in height between the upper surface of the die plate and the upper surface of the lower inner and the difference in thickness after molding between the portions to be of an equal thickness of the compact determined in the second preparation, to find out an estimated difference in thickness after molding;

applying the estimated difference to the relation between the advancing speed of the holder and the difference in thickness after molding determined in the first preparation, to find out the advancing speed of the holder at which the difference in thickness becomes zero; and adjusting the advancing speed of the holder accordingly.

5. The method for packing a powder material into a die cavity according to claim 2, wherein the difference in thickness after molding between the portions to be of an equal thickness of the compact is a difference in thickness between two portions of an annular compact with a through-hole that are located symmetrically on opposite sides of the through-hole.

6. The method for packing a powder material into a die cavity according to claim 3, wherein, when a rear portion is measured to be thicker than a front portion as the measured difference in thickness of the compact, an adjustment value is added to a current setting of the advancing speed of the holder such that the measured difference in thickness of the compact becomes zero, and when the rear portion is measured to be thinner than the front portion as the measured difference in thickness of the compact, an adjustment value is subtracted from the current setting of the advancing speed of the holder such that the measured difference in thickness of the compact becomes zero.

7. The method for packing a powder material into a die cavity according to claim 1, wherein a retracting speed of the holder is a predetermined same speed.

8. The method for packing a powder material into a die cavity according to claim 1, wherein the advancing speed of the holder is constant.

9. The method for packing a powder material into a die cavity according to claim 1, wherein the relation between the advancing speed of the holder and a difference in thickness after molding between the portions to be of an equal thickness of the compact is determined in the first preparation, the relation includes data on a case where a speed of the holder is changed while the holder is advancing, and the adjustment includes changing the speed of the holder while the holder is advancing.

10. The method for packing a powder material into a die cavity according to claim 1, further comprising:

adjusting the advancing speed of the holder based on the relation determined in the first preparation, to a speed at which the packing density becomes uniform by causing a front-rear difference in packing density when the holder is advanced so as to offset the front-rear difference in packing density of the powder material estimated to occur when the holder is retracted.

* * * * *